US010976032B2

(12) United States Patent
Gilbert et al.

(10) Patent No.: US 10,976,032 B2
(45) Date of Patent: Apr. 13, 2021

(54) LUMINAIRE COMPRISING AN LED CHIP

(71) Applicant: SLS SUPER LIGHT SOLUTIONS UG (HAFTUNGSBESCHRÄNKT), Berlin (DE)

(72) Inventors: Michael Gilbert, Bad Oldesloe (DE); Peter Gilbert, Bad Oldesloe (DE); Olaf Heinrich König, Hamburg (DE)

(73) Assignee: SLS Superlight Solutions UG, Berlin (DE)

( * ) Notice: Subject to any disclaimer, the term of this patent is extended or adjusted under 35 U.S.C. 154(b) by 0 days.

(21) Appl. No.: 15/524,662

(22) PCT Filed: Nov. 9, 2015

(86) PCT No.: PCT/EP2015/002254
§ 371 (c)(1),
(2) Date: Feb. 25, 2019

(87) PCT Pub. No.: WO2016/071003
PCT Pub. Date: May 12, 2016

(65) Prior Publication Data

US 2019/0368695 A1 Dec. 5, 2019

(30) Foreign Application Priority Data

Mar. 17, 2015 (DE) ..... 10 2015 003 321.2

(51) Int. Cl.
*F21V 19/04* (2006.01)
*F21Y 115/10* (2016.01)

(52) U.S. Cl.
CPC ..... *F21V 19/04* (2013.01); *F21Y 2115/10* (2016.08)

(58) Field of Classification Search
CPC ..... F21V 19/04; F21V 17/005; F21V 17/04; F21V 17/06; F21V 19/003; F21V 14/02
See application file for complete search history.

(56) References Cited

U.S. PATENT DOCUMENTS

| | | | | |
|---|---|---|---|---|
| 4,583,287 | A | 4/1986 | McDevitt | |
| 4,666,199 | A * | 5/1987 | Cheh | H05K 13/0491 294/106 |
| 5,875,544 | A | 3/1999 | Chou | |
| 2005/0207165 | A1 | 9/2005 | Shimizu et al. | |
| 2005/0265024 | A1* | 12/2005 | Luk | F21V 19/02 362/231 |
| 2006/0087843 | A1* | 4/2006 | Setomoto | H05B 33/0803 362/249.01 |
| 2007/0215884 | A1 | 9/2007 | Wu | |
| 2008/0130275 | A1* | 6/2008 | Higley | F21L 4/027 362/184 |

(Continued)

FOREIGN PATENT DOCUMENTS

| | | | |
|---|---|---|---|
| DE | 297 17 179 | U1 | 1/1998 |
| WO | 2008148029 | A1 | 12/2008 |

OTHER PUBLICATIONS

International Search Report.

*Primary Examiner* — Matthew J. Peerce
(74) *Attorney, Agent, or Firm* — Michael J. Brown

(57) ABSTRACT

The invention relates to a luminaire comprising a removable LED chip as an illuminant, a tool for transporting and replacing the removable LED chip, and a combination kit encompassing the luminaire and the tool for transporting and replacing the removable LED chip.

9 Claims, 17 Drawing Sheets

(56) References Cited

U.S. PATENT DOCUMENTS

| | | | | |
|---|---|---|---|---|
| 2009/0103296 | A1* | 4/2009 | Harbers | F21V 29/83 362/234 |
| 2010/0302758 | A1* | 12/2010 | Wang | F21S 9/022 362/20 |
| 2011/0111632 | A1 | 5/2011 | Naito | |
| 2012/0033429 | A1* | 2/2012 | Van De Ven | F21V 23/0442 362/294 |
| 2013/0128581 | A1 | 5/2013 | Hsu | |
| 2013/0329434 | A1* | 12/2013 | Packard | F21V 19/04 362/311.01 |
| 2015/0098230 | A1* | 4/2015 | Tamura | F21V 29/70 362/382 |

* cited by examiner

LUMINAIRE COMPRISING AN LED CHIP

BACKGROUND OF THE INVENTION

Field of the Invention

The invention concerns a light or luminaire that has an LED chip as the light source, a device for transporting and replacing an LED chip and a set with a light or luminaire and a device for transporting and replacing an LED chip.

Numerous LED lights are known from prior art. Lights that have LED chips as the light source are also known. The problem with these lights according to prior art is that the LED chips are difficult to remove. This can be completed according to current prior art only by qualified technicians using a soldering iron. The entire light is often thrown away the same, or the light source, fails, which creates unnecessary electrical waste.

It is the task of the present invention to improve such lights known from prior art.

BRIEF SUMMARY OF THE INVENTION

This is realised by means of a light according to one of the claims 1 to 11 and a device for transporting and replacing an LED chip according to one of the claims 12 to 15.

A light that has at least one LED chip as a light source is characterised according to the invention in that the LED chip can be replaced in that the chip is (non-destructively) disconnectably integrated into the light. A fixing of the LED chip within the light can in particular be guaranteed by means of positive or a frictional connection. For this the light is preferably also designed in such a way that a replacement of the LED chip is possible without dismantling the light.

A "light" should here be understood as various lights that are identically constructed or modified and are equipped with one or more LED chips, such as for example site lighting, street lights, stadium floodlights, living room floodlights, living room lights, workplace floodlights, cinema lighting, film, photographic or event illumination, TV studio lights, car headlights and lights for illuminating pool systems.

A replacement of the LED chips can be made possible with the present invention through mechanical connecting, in particular in a positive or frictional way, and simultaneous electrical contacting. It is in particular envisaged according to the invention that no firmly bonded integration of the LED chip is realised. This can contribute towards minimising the waste of resources, as a user of the light according to the invention is offered the possibility of purchasing an innovative, energy-saving as well as sustainable product. The present invention makes it possible to replace the LED chip in a light oneself with simple movements. The simple and fast changing of different colour tones in the lights is also made possible by this simple method. Sensitive transformers installed for controlling the LED chips can also be replaced by means of a simple plug & play process, i.e. a mechanical plug-in and electric socket connection. The replacement function can in particular be realised with a plug-in, screw-in or tilting device.

It can preferably be envisaged that the light has a replacement shaft (in a housing). A simple insertion of the LED chip into the housing and a simple removal of the LED chip from the housing can be realised with such a replacement shaft.

A ventilation shaft (in a housing of the light) can also advantageously be envisaged in the light according to the invention. This can preferably be envisaged on the level of the LED chip.

In a preferred design of the light according to the invention it can further be envisaged that the same has a holder for the LED chip, wherein the holder has a plate with a chip holder and a current collector into which the LED chip is fitted.

The holder can also preferably be arranged on a tube.

DETAILED DESCRIPTION OF THE INVENTION

It can further preferably be envisaged that the light has a power supply which can be replaced. A replacement of the power supply can particularly preferably also be possible without dismantling the light. The power supply can for example be integrated into the light by means of a plug-in connection. Such a power supply can in particular comprise a transformer. Such a power supply can further also comprise a driver unit, into which a control software for the light and/or a processor for implementing the control software is/are integrated.

The light according to the invention can also preferably have two or more LED chips.

It can preferably be envisaged that the, or at least one LED chip (i.e. its radiation direction) is arranged at an angle to the light that is adjustable.

It can also be envisaged that the, or at least one LED chip is arranged adjustably with regard to a light level at a depth, i.e. with regard to the distance of this light level.

In a preferred design of the light according to the invention it can also be envisaged that the LED chips are mounted rotatably. A rotatability can in particular be envisaged around a body axis that is aligned parallel or coaxial to the (central) radiation direction of the light of the LED chip.

The invention further concerns a device for transporting and replacing an LED chip, in particular for use with a light according to the invention.

It can preferably be envisaged with the device according to the invention that the LED chip is held covered in the device in a closed position of the device.

It can further be envisaged that the LED chip is held open in the device in an opened position.

It can also preferably be envisaged that the LED chip can be separated from the device in a released position of the same.

The invention further concerns an LED chip for use in a light according to the invention and/or for use with a device according to the invention.

The invention further concerns a method for replacing an LED chip of a light according to the invention, in particular using a device according to the invention.

The invention will now be explained in more detail with the aid of drawings and with reference to embodiment examples. These respectively show in a simplified illustration:

Figure 1:
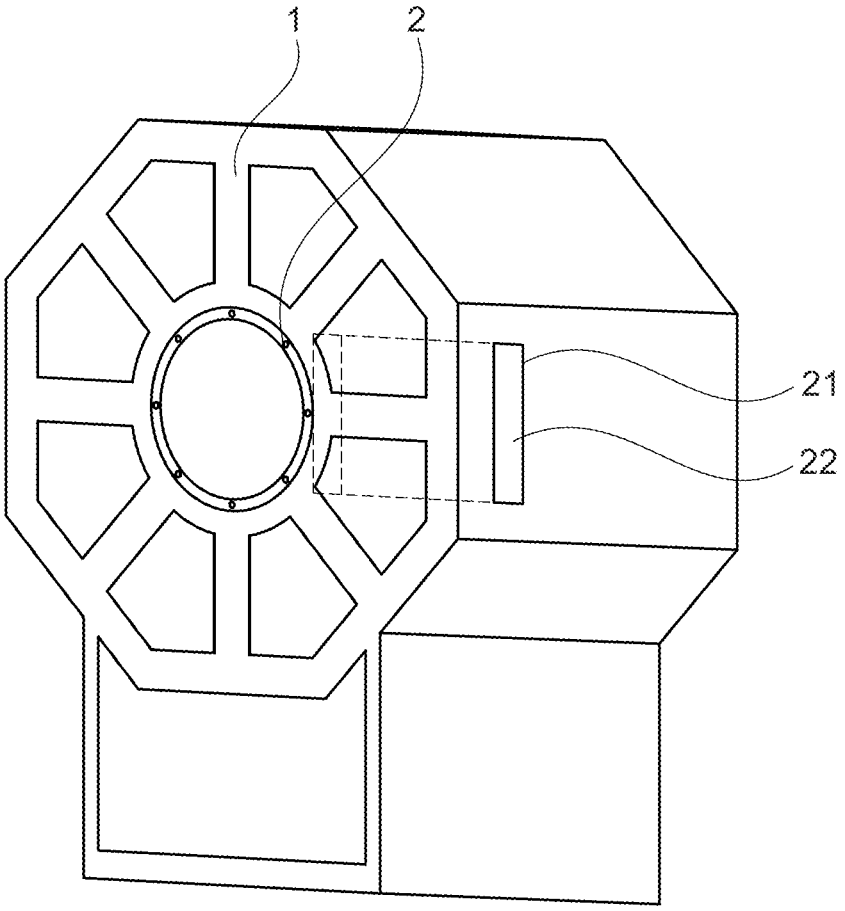
FIG. 1: a light according to the invention in a design of a single light in a perspective view (without reflectors and LED chip)
Figure 2:
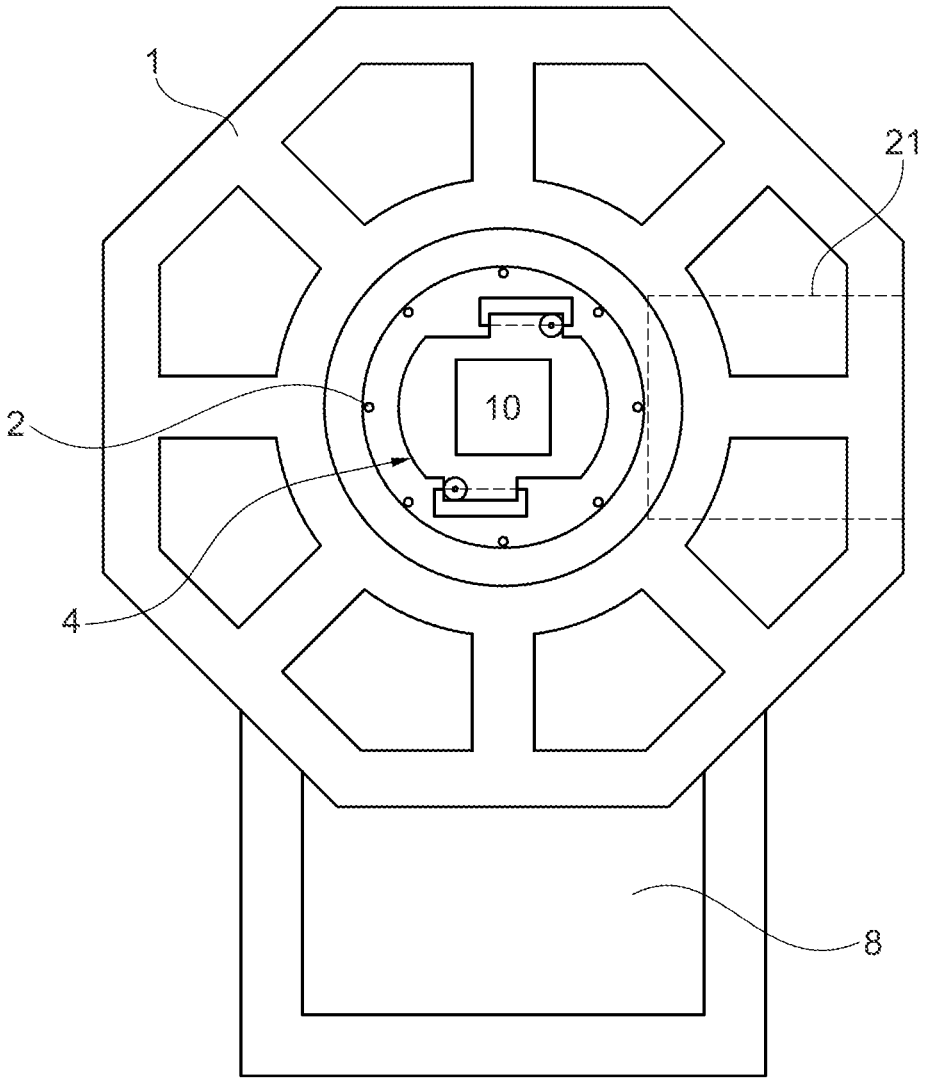
FIG. 2: a front view of the light.
Figure 9:
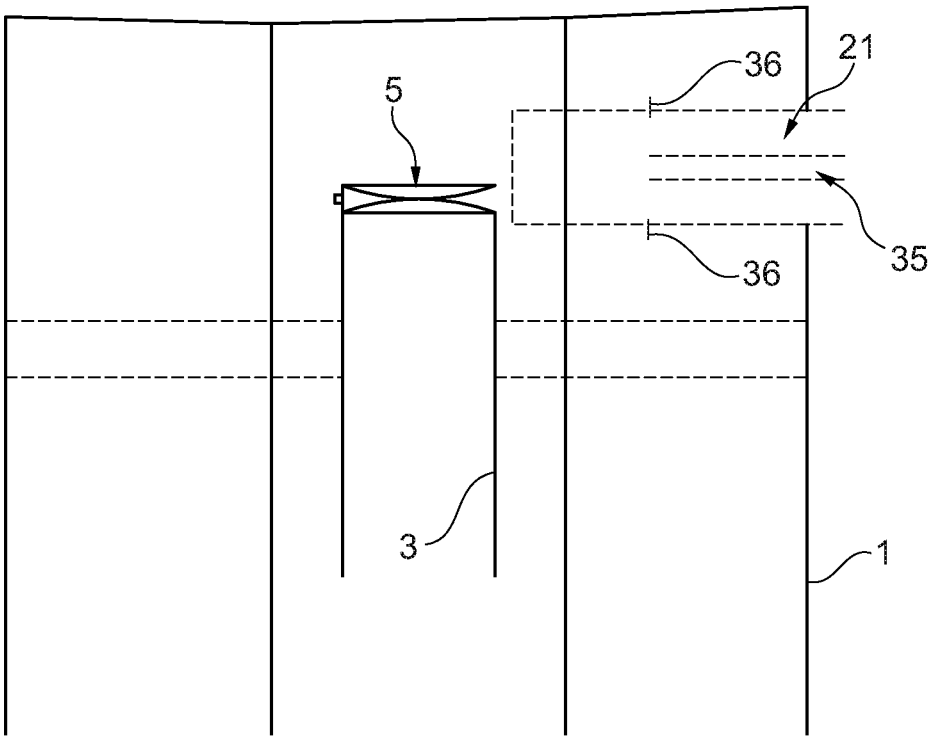
FIG. 9: a much simplified side view of the light.

The light shown in FIGS. 1 and 2 comprises a housing 1, in particular an aluminium housing. An external section of the housing 1 is connected with a cylindrical internal section via struts. Inside the internal section one or more pivot bearing elements 2, for example ball bearings, are located. A tube 3 (compare FIG. 9, 10, 12) is pivotably mounted inside the pivot bearing elements 2. Sufficient free space for allowing air circulation is formed in its inner area by designing the housing 1 with the struts.

A light source in the form of an LED chip 4 (for example a high-performance chip, in particular a quantum dot LED chip) is affixed to the facing side of the tube 3. For this a plate is fitted to the tube 3, on which a chip holder 5 (compare FIG. 6) with current transmitters 6 can be located. Power cables for supplying the LED chip 4 with electric energy run inside the tube 3. This further serves for cooling the LED chip 4. The pivotability of the tube 3 with the LED chip 4 affixed to the same allows it to be rotated by up to 360°.

Cooling of the LED chip 4 is primarily realised by means of an air stream generated by a fan 7, which is taken in through an air supply shaft 8 located at the same height as the LED chip 4, related to the longitudinal axis of the tube 3. The air stream exiting the air supply shaft 8 is routed across the LED chip 4 and subsequently vented via an exhaust air shaft 9. At the distal end of the tube 3 in relation to the LED chip 4 a further fan (not illustrated) is arranged, which also vents heat away from the LED chip 4.

Figure 4:
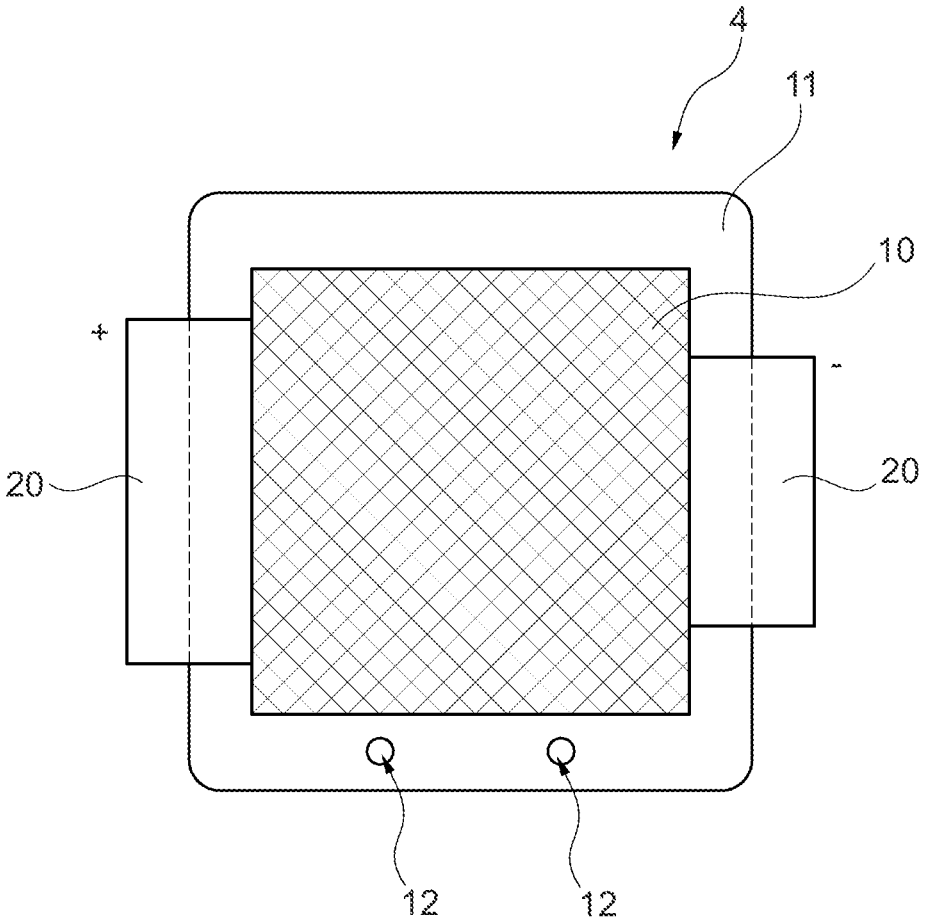
FIG. 4: a top view of an LED chip for use with a light.
Figure 5:
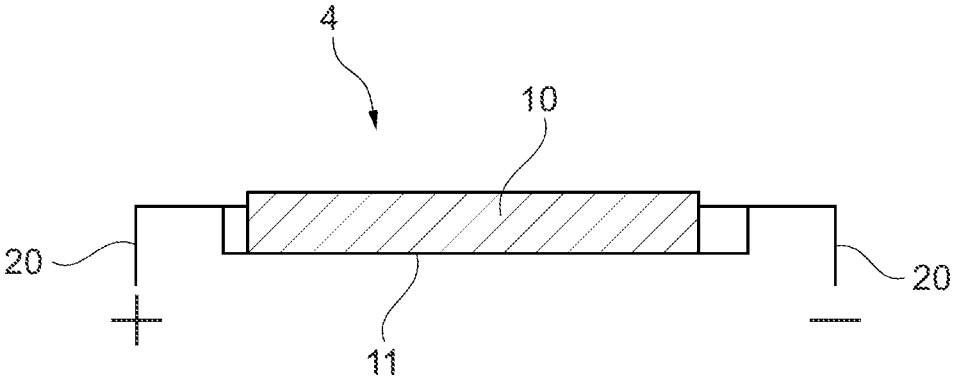
FIG. 5: a side view of the LED chip.

FIGS. 4 and 5 show the construction of the LED chip in isolated views. An illuminated area 10 of the LED chip 4 is located on a (metal) base plate 11. This base plate 11 is intended as a holding plate for the LED chip and also serves as a current conducting connection piece between the illuminated area 10 and a power supply for the LED chip 4. The base plate 11 also has two connection openings 12, which serve for installing the LED chip 4, using a suitable device, a so-called light key 13, in the light or for removing the same from the light.

Figure 6:
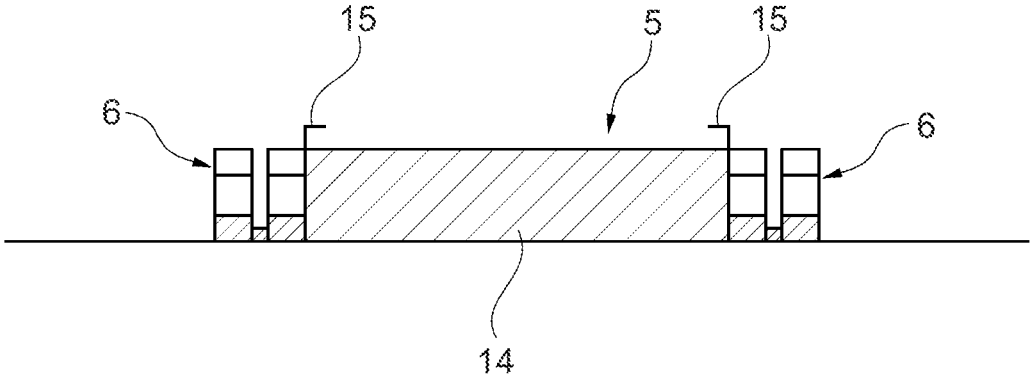
FIG. 6: the chip holder of the light in an isolated illustration.
Figure 7:
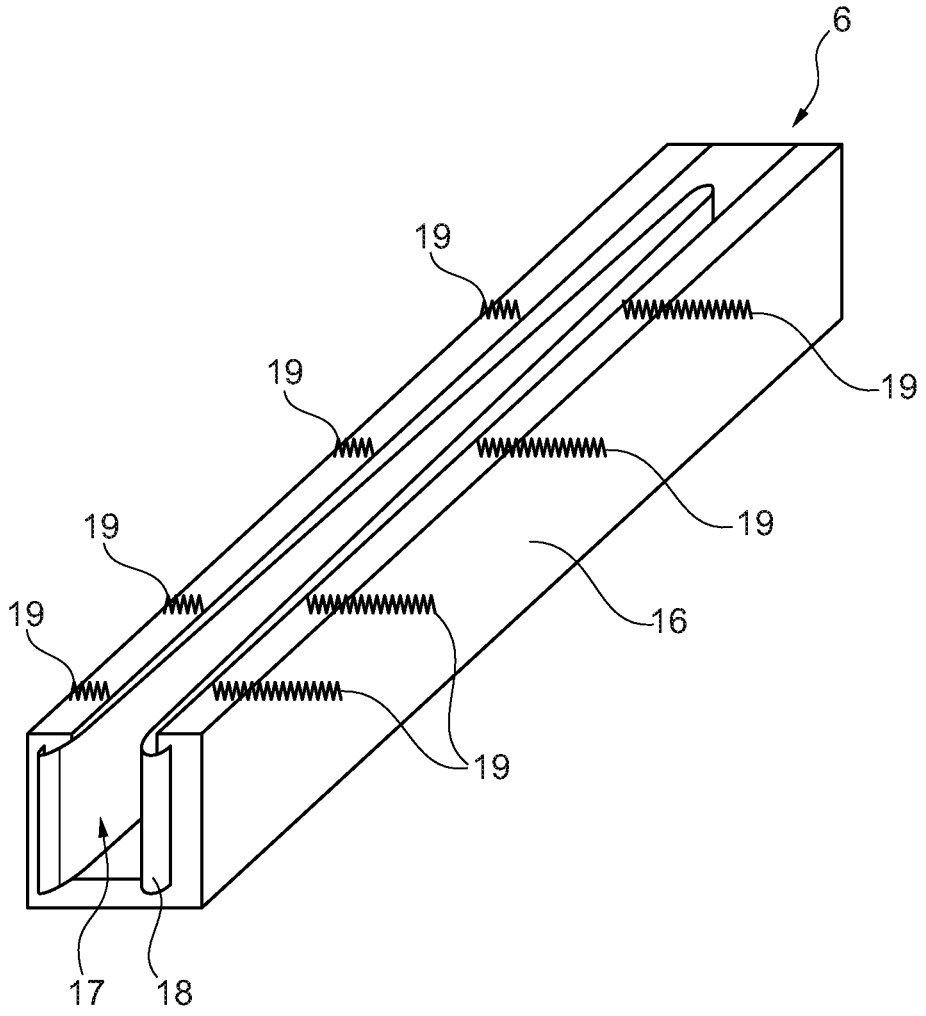
FIG. 7: A current transmitter of the chip holder in an isolated view.

FIG. 6 shows the chip holder 5 of the light in a side view. This comprises a glide surface element 14 that forms a glide surface on which the base plate 11 of the LED chip 4 can glide. Holding elements 15 are connected with the glide surface element 14 at two opposing edges of the glide surface, which each form a guide slot with the glide surface, in which an edge section of the base plate 11 of the LED chip 4 can be guided. A current transmitter 6 each also extends along the sides of the glide surface element 14 along which the holding elements 15 are fitted. One of these current transmitters 6 is shown in the isolated illustration of FIG. 7.

Each of the current transmitters 6 comprises an elongated base body 16 that forms a receiving slot 17, which extends starting from one of the facing sides with decreasing width up to the vicinity of the second facing side and which is designed open on a freely exposed top of the current transmitter 6, which lies at approximately the same height as that of the glide surface of the glide surface element 14. The receiving slot 17 is delimited on both sides by a (folded) metal current transmitter sheet 18. The legs of the metal current transmitter sheet 18 are compressed by means of compression springs 19.

The LED chip 4 is pushed under the holding elements 15 of the chip holder 5 in a sideways direction with its base plate 11, which is coated with a heat conductive paste. At the same time the current collectors 20 of the LED chip 4, which initially extend from two opposing sides of the base plate 11 or the illuminated surface 10 in a sideways direction and are then angled downwards, for inserted from the side into the receiving slot 17 of the respective associated current transmitter 6, which electrically integrates the LED chip 4 into the light. The base plate of the LED chip 4 can also be pressed against the glide surface of the chip holder 5 by means of pressure springs (not illustrated). Overall an adequate positive connection fitting of the LED chip 4 in the chip holder 5 results.

Figure 3:
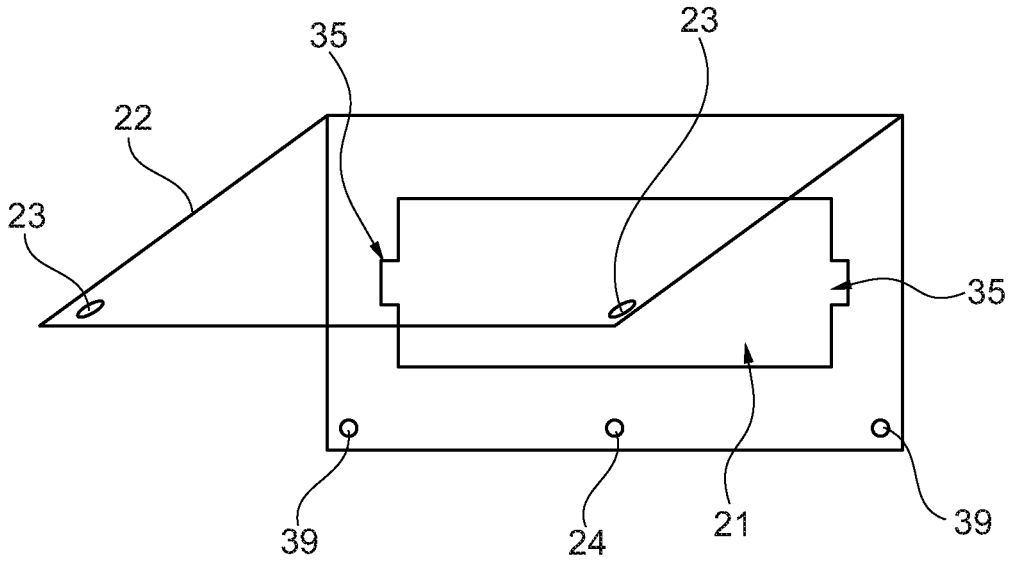
FIG. 3: a top view of the replacement shaft of the light in an isolated illustration.

To enable a replacement of the LED chip 4 of the light the latter has a replacement shaft 21. The replacement shaft 21 is arranged at the height of the LED chip 4, related to the longitudinal axis of the tube 3. The replacement shaft 21 can be closed on the outside by means of a shaft flap 22 (compare in particular FIG. 3). In the closed condition the shaft flap 22 is secured with threaded bolts 23. These threaded bolts 23 can be unscrewed, which will open the shaft flap 22. Upon opening a micro switch 24 with a twin opening contact is triggered, which interrupts the current supply to the light. The replacement shaft 21 is now exposed.

The light key 13 can be inserted into the replacement shaft 21. Every replacement LED chip 4 can be located in such a light key 13. An empty light key 13 is supplied with a light as part of a set to enable a replacement of the LED chip 4. The light key 13 is used as a transport box as well as for replacing the LED chip 4 in the light.

The light key 13 comprises a housing 25 with a central part 26 as well as a first end part 27 and a second end part 28 (compare for example FIG. 8), which can each be lowered into the central part 26. The end parts 27, 28 are each driven into the extended position by means of compression springs 28. A guide strut 30, at the end of which an LED chip 4 can be held, extends from an internal bottom surface of the second end part 28. The LED chip 4 is then located within the volume delimited by the first end part 27 in the extended position. The free facing side of the end part 27 forms a through opening, which can be closed by means of a closure cap 31.

Figure 14:
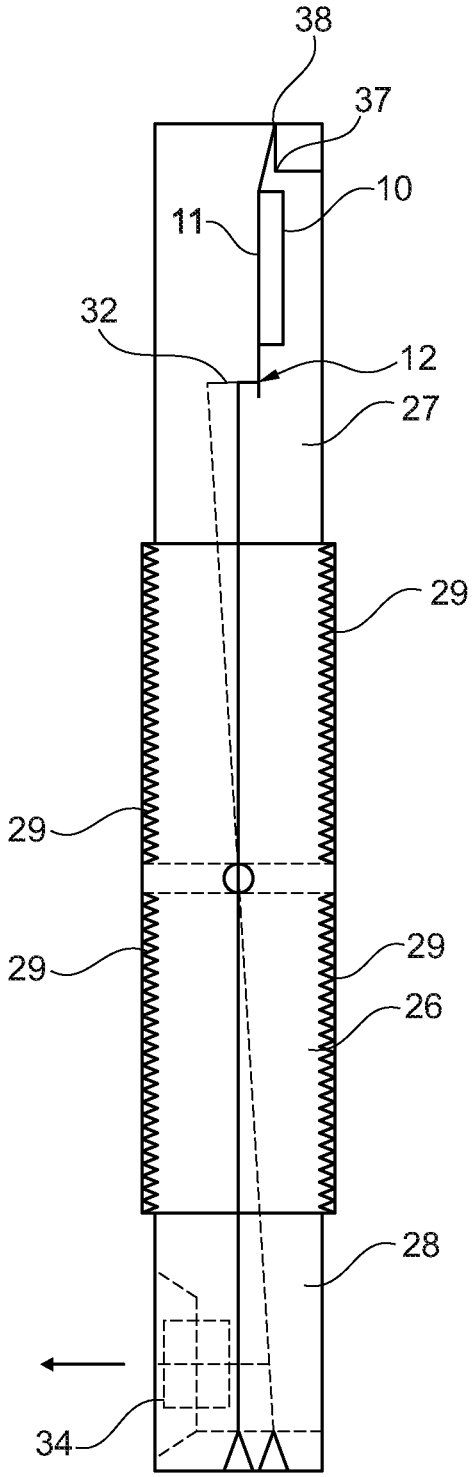
FIG. 14: a longitudinal section through the light key.

Two securing hooks 32, which engage the connection openings 12 of the base plate 11 of the LED chip 4 in a closed position, serve for the disconnectable fitting of the LED chip 4 on the guide strut (compare FIG. 14). The securing hooks 32 are mounted in a seesaw fashion and can be pushed into the closed position or an open position in which the same does not engage the connection openings 12, by means of a mechanical switch 33 integrated into the second end part.

In order to insert an LED chip 4 into the light or remove an LED chip 4 from the light the light key 13 is pushed into the replacement shaft 21 whilst applying pressure. Differently sized and/or positioned guide projections 34 of the light key 13, which engage the corresponding guide grooves 35 of the replacement shaft 21 (compare for example FIG. 3) guarantee that the light key 13 can only be pushed into the replacement shaft 21 in one alignment here.

Figure 10:
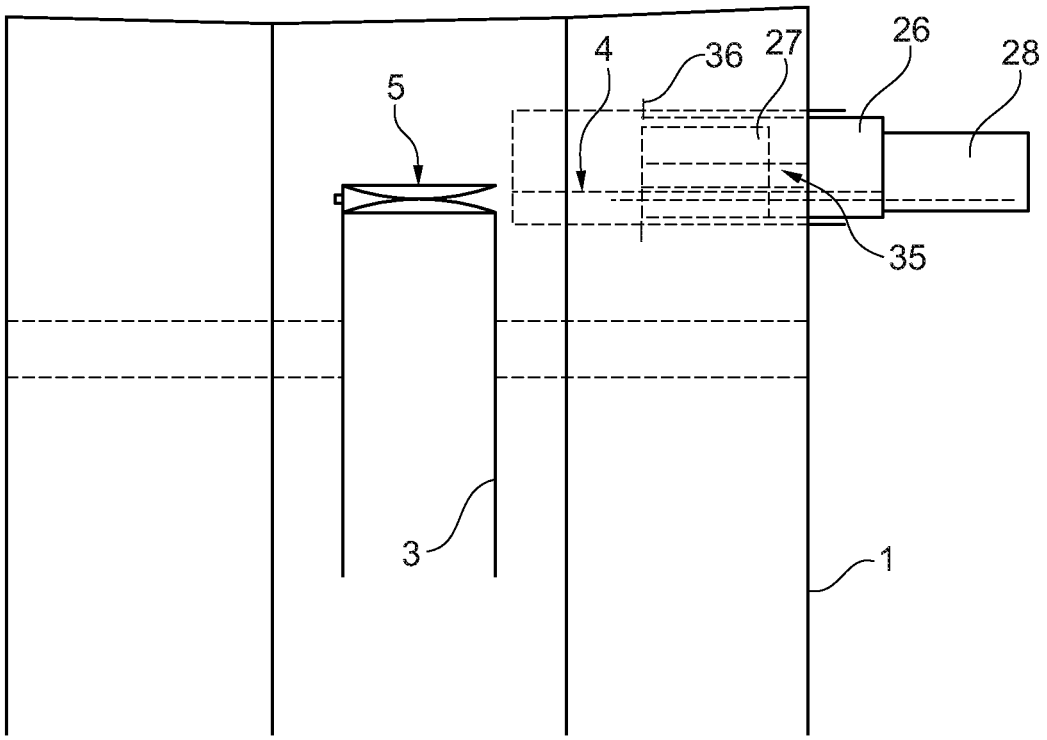
FIG. 10: an illustration of the light according to FIG. 9 with the light key inserted in an interim position.
Figure 11:
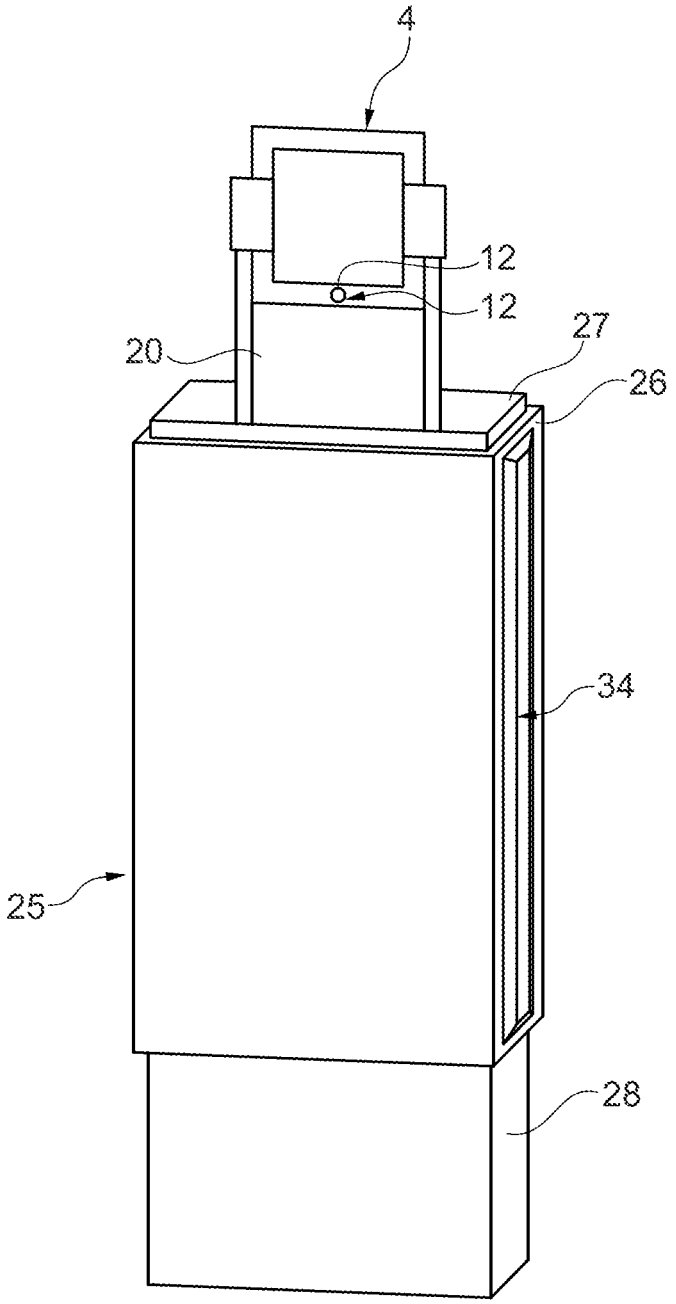
FIG. 11: the light key in the interim position.

When pushing the light key 13 into the replacement shaft 21 the first end part 27 of the light key 13 moves into the replacement shaft 21 first (compare FIG. 10) until the same hits stoppers 36. Pushing the central part 26 of the light key 13 further into the replacement shaft 21 will then result in a lowering of the first end part 27, which would push the LED chip 4 through the closure cap 31 that now opens. The LED chip 4 also slides across a cartridge 37 located inside the first end part 27 here, in which the heat conductive paste is located. This coats the base plate 11 of the LED chip 4 with an even layer of the heat conductive paste using a scraper 38. The LED chip 4 is now freely exposed, held by the guide strut 30 whilst using the securing hook 32 (compare FIGS. 10 and 11).

Figure 12:
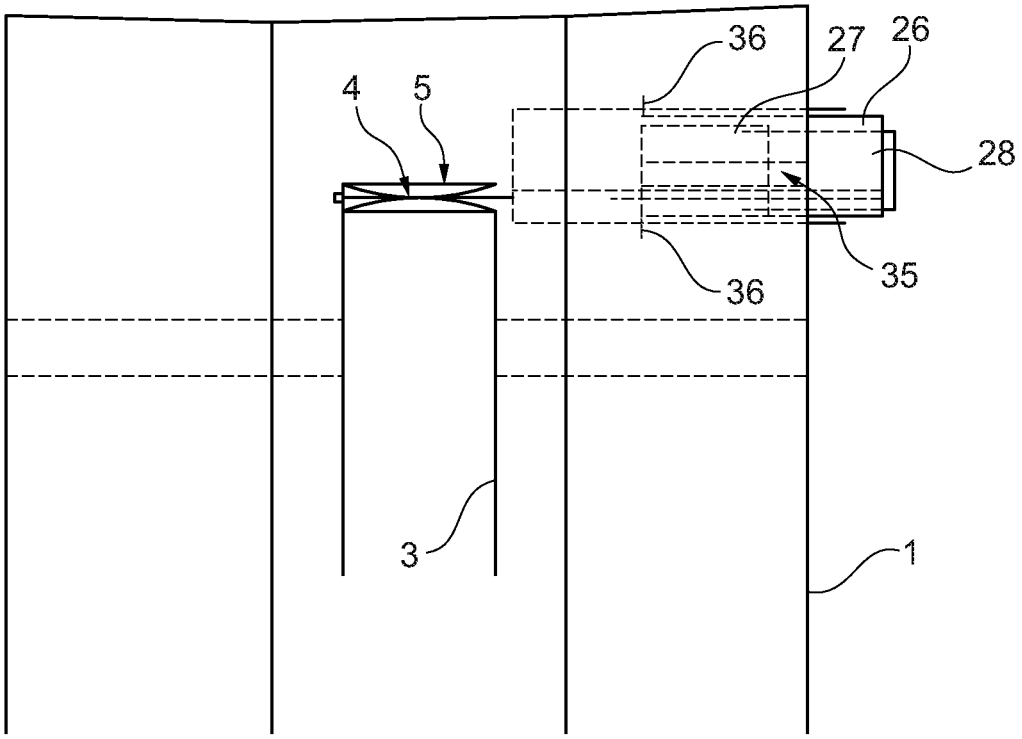
FIG. 12: an illustration of the light according to FIG. 9 with the light key installed in a handover position.
Figure 13:
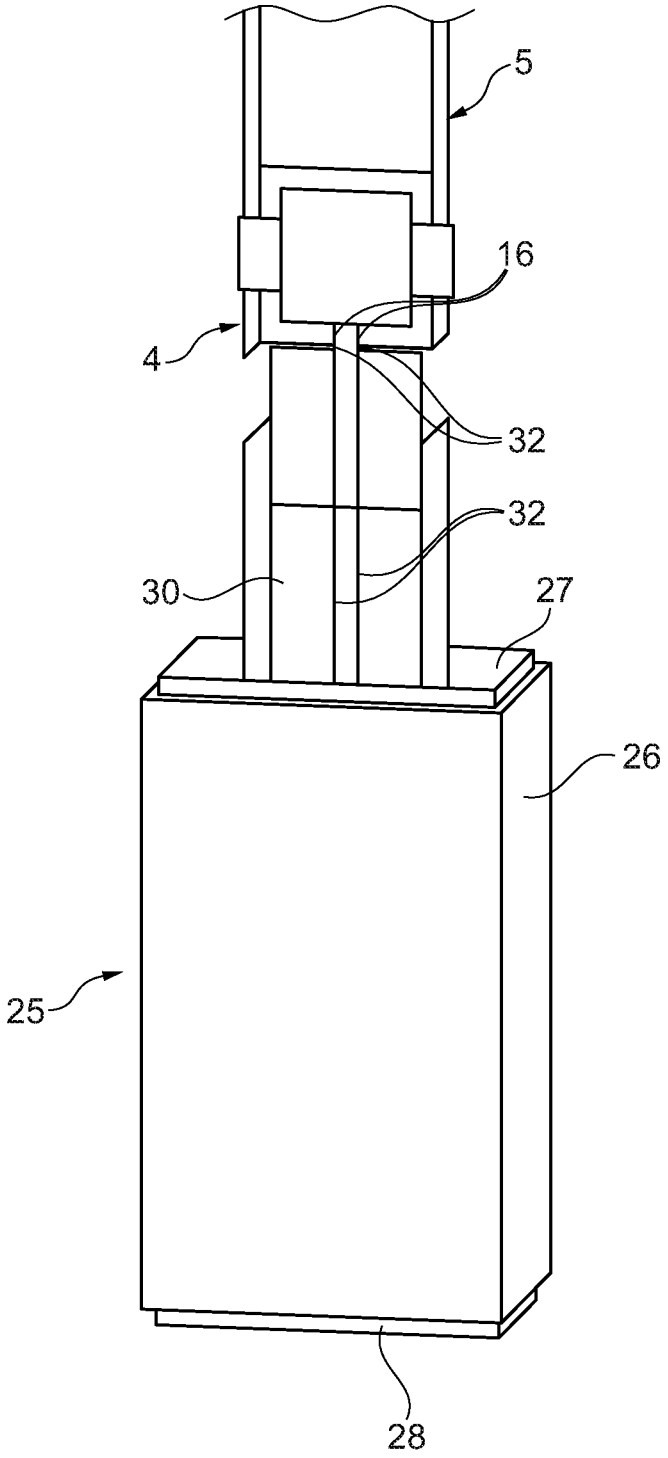
FIG. 13: the light key in the handover position.

Pushing the light key 13 in further will now result in the second end part 28 is lowered into the central part 26, which also hits the stoppers 36, which brings the LED chip 4 into a handover position inside the light or the replacement shaft 21 (compare FIGS. 12 and 13). The LED chip 4 with its base plate 11 is secured between the glide surface element 14 and the holding elements 15 of the chip holder 5 in the described way here and electrically integrated into the light by means of the current collectors 20 contacting the metal current transmitter sheets 18. The LED chip 4 can then be released from the light key 13 by means of the mechanical switch 33.

Figure 8:
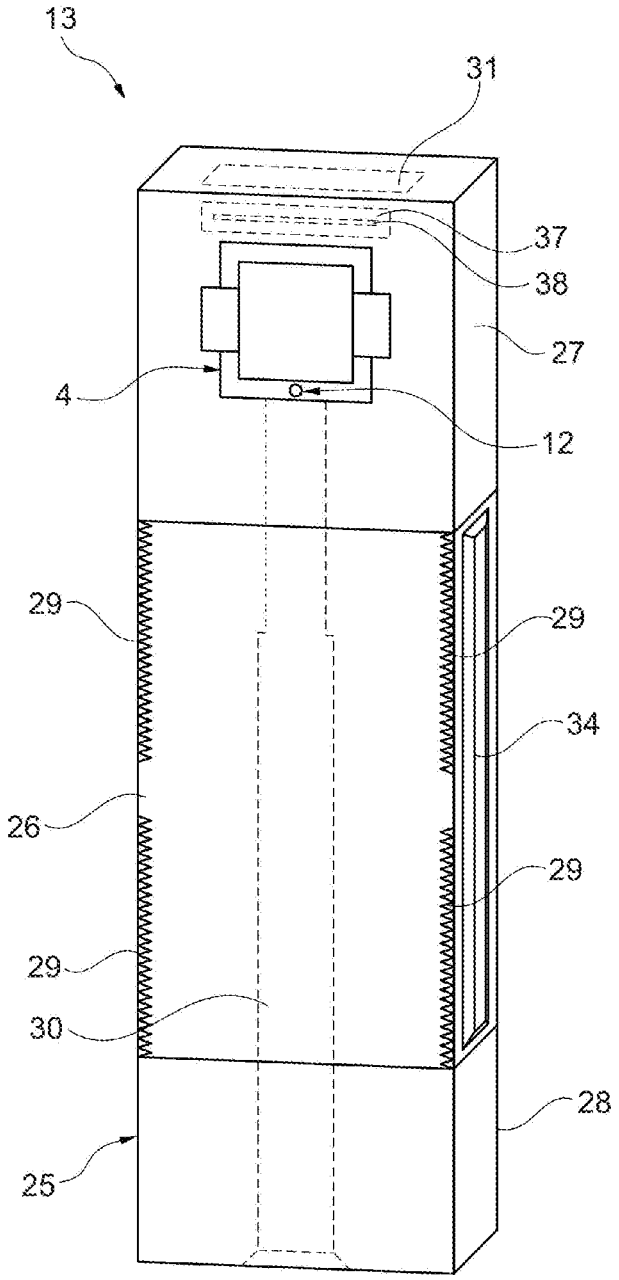
FIG. 8: a light key in a transport position for use with the light.

When the light key 13 is let go it will be moved back into its transport position according to FIG. 8 without the LED chip 4 due to being subject to the pre-tensioned compression springs 29 and simultaneously partly exits from the replacement shaft 21.

Once an LED chip 4 has been inserted into the light the shaft flap 22 can be closed and the threaded bolts 23 can be screwed into the receiving points 39 envisaged for the same. The reconstituted closed position of the shaft flap 22 signals a release to the micro switch 24 and the current flow is reinstated.

Instead of a mechanically or manually activated light key 13 this can also be designed to be activated automatically at least in part. In this case an electrical gear motor with gearwheels and spindles can for example replace mechanical functions.

Figure 15:
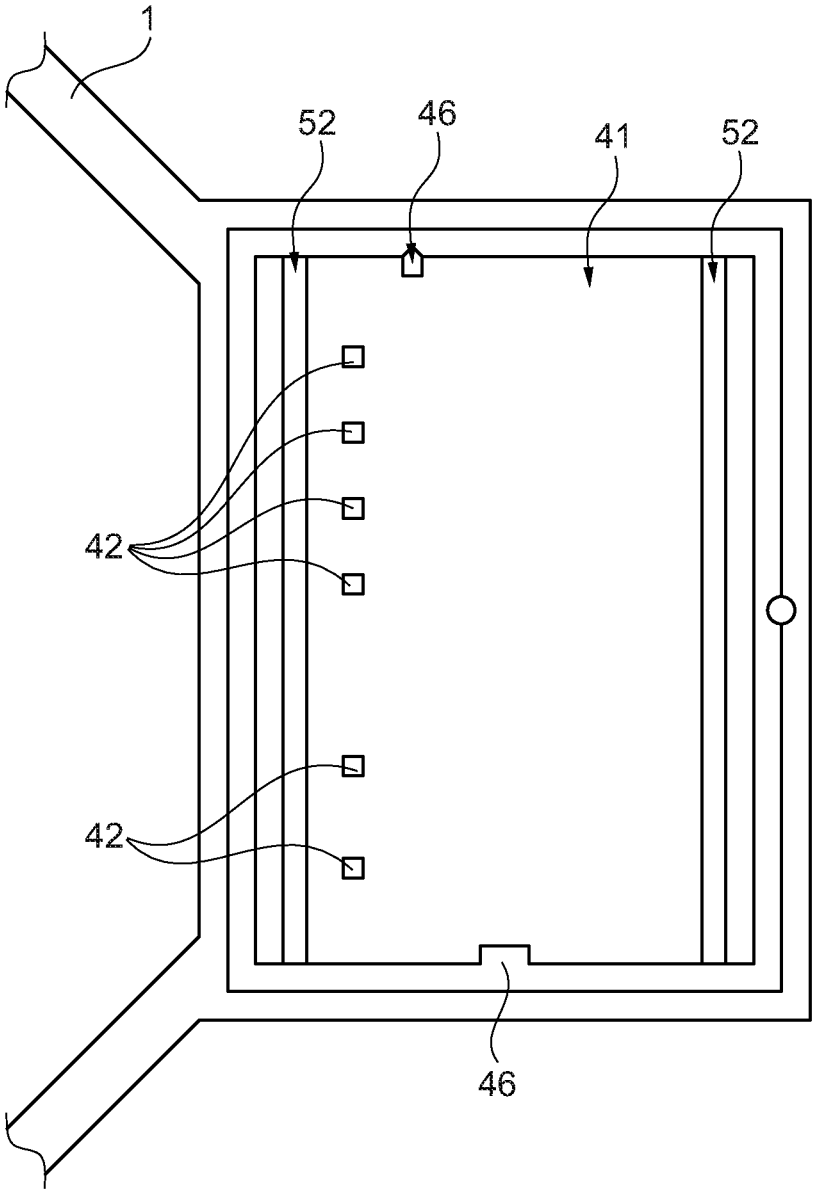
FIG. 15: a top view of the supply shaft of the light.
Figure 16:
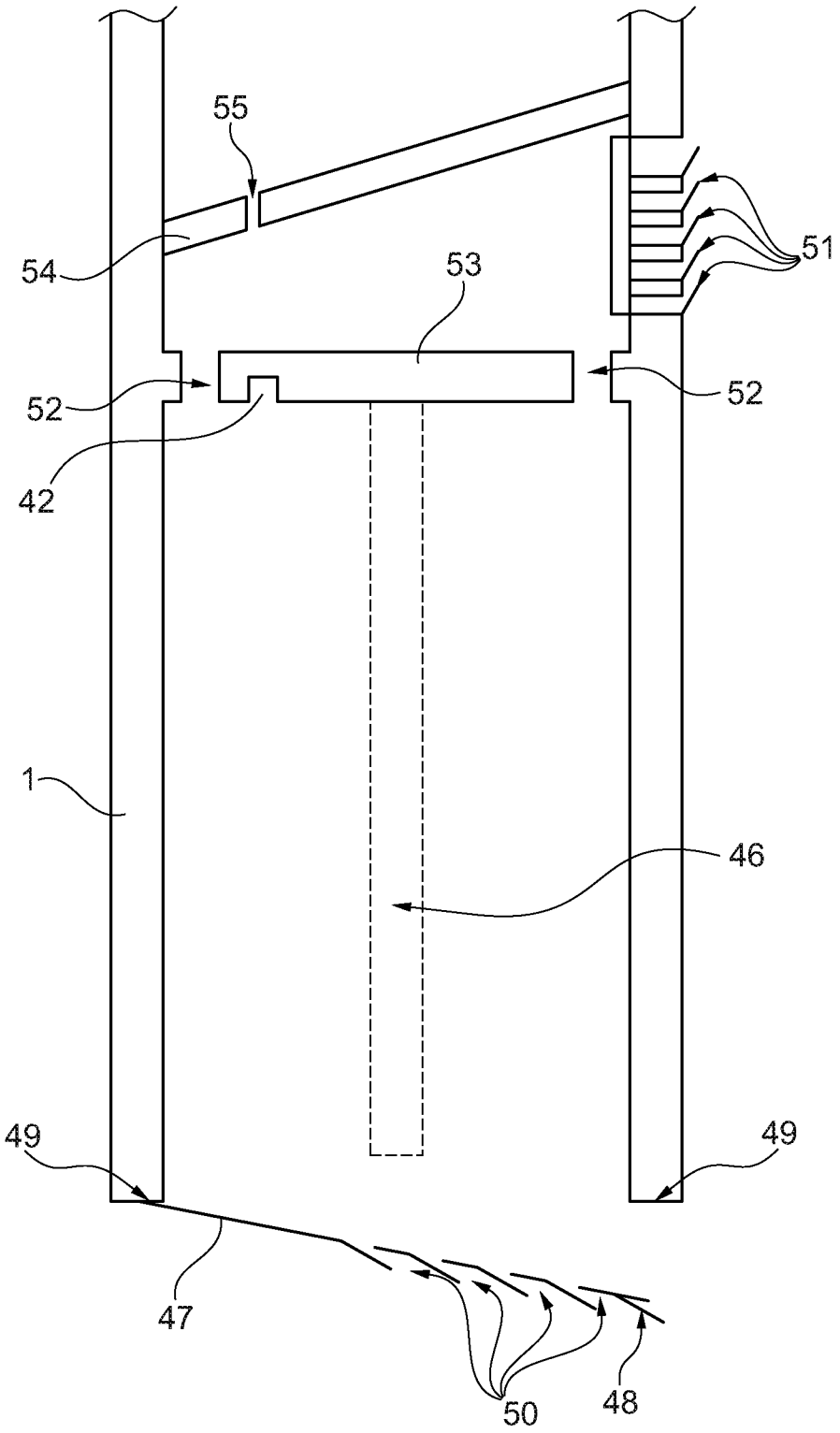
FIG. 16: a section through the supply shaft.
Figure 17:
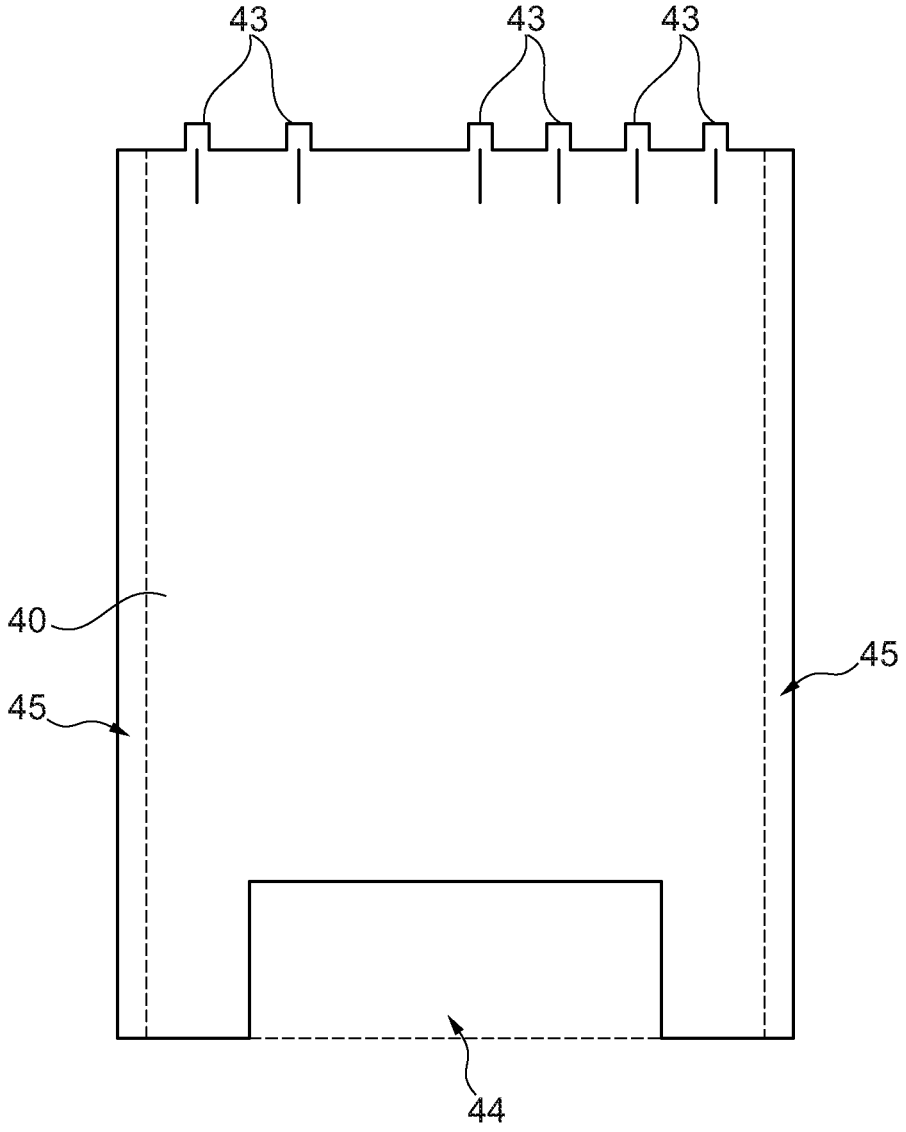
FIG. 17: a side view of the plug-in transformer of the lights.

The light according to the invention also enables a simple replacement of an associated plug-in transformer 40 received inside the housing 1 (compare FIG. 17). A supply shaft 41 (compare FIGS. 15 and 16) is envisaged inside the housing 1 for this. Connections 42 for the supply of power for the output voltage and secondary output voltage receivers are firmly anchored inside the same. The plug-in transformer 40 can be connected to these by means of corresponding connectors 43. The plug-in connector 40 can be manually inserted into the supply shaft 41 for this. A handle recess 44 can be used as a handle when inserting the plug-in transformer 40. The design of differently positioned and/or dimensioned guide grooves 45 in the two side walls of the plug-in connector 40, which are engaged by corresponding guide projections 46 in the wall of the supply shaft 41, can ensure that the plug-in transformer 40 can be pushed into the supply shaft 41 in one alignment direction only.

According to FIG. 16 the housing opening of the supply shaft 41 is designed to be closable by means of a shaft flap 47 (compare FIG. 16). The shaft flap 47 can for example be fixed in the closed position by means of a bolting 48. A sealing element 49 can prevent or limit an ingress of moisture and other contamination here. (Lamellae) inlet openings 50 can be envisaged in the shaft flap 47 for ventilating the plug-in transformer 40. A cooling air stream generated by means of a fan (not illustrated) can enter the supply shaft 41 through the inlet openings 50, flow around and/or through the plug-in transformer 40 and leave the housing 1 of the light once more via (lamellae) outlet openings 51. Through openings 52 in the facing wall 53 receiving the connectors 42 and delimiting the supply shaft 41 guarantee a guiding of the cooling air stream up to the outlet openings 51. A bulkhead 54 deflects the cooling air stream flowing via the through openings 52 in the direction of the outlet openings 51. Electrical conductors (not illustrated) that electrically connect the connectors 42 in the facing wall 53 of the supply shaft 41 (as well as possibly a driver unit, not illustrated, arranged between the facing wall 53 and the bulkhead 54) with a control unit (not illustrated) arranged on the other side of the bulkhead 54 (in relation to the facing wall 53) can be routed through a cable gland 55 in the bulkhead 54.

Figure 18:
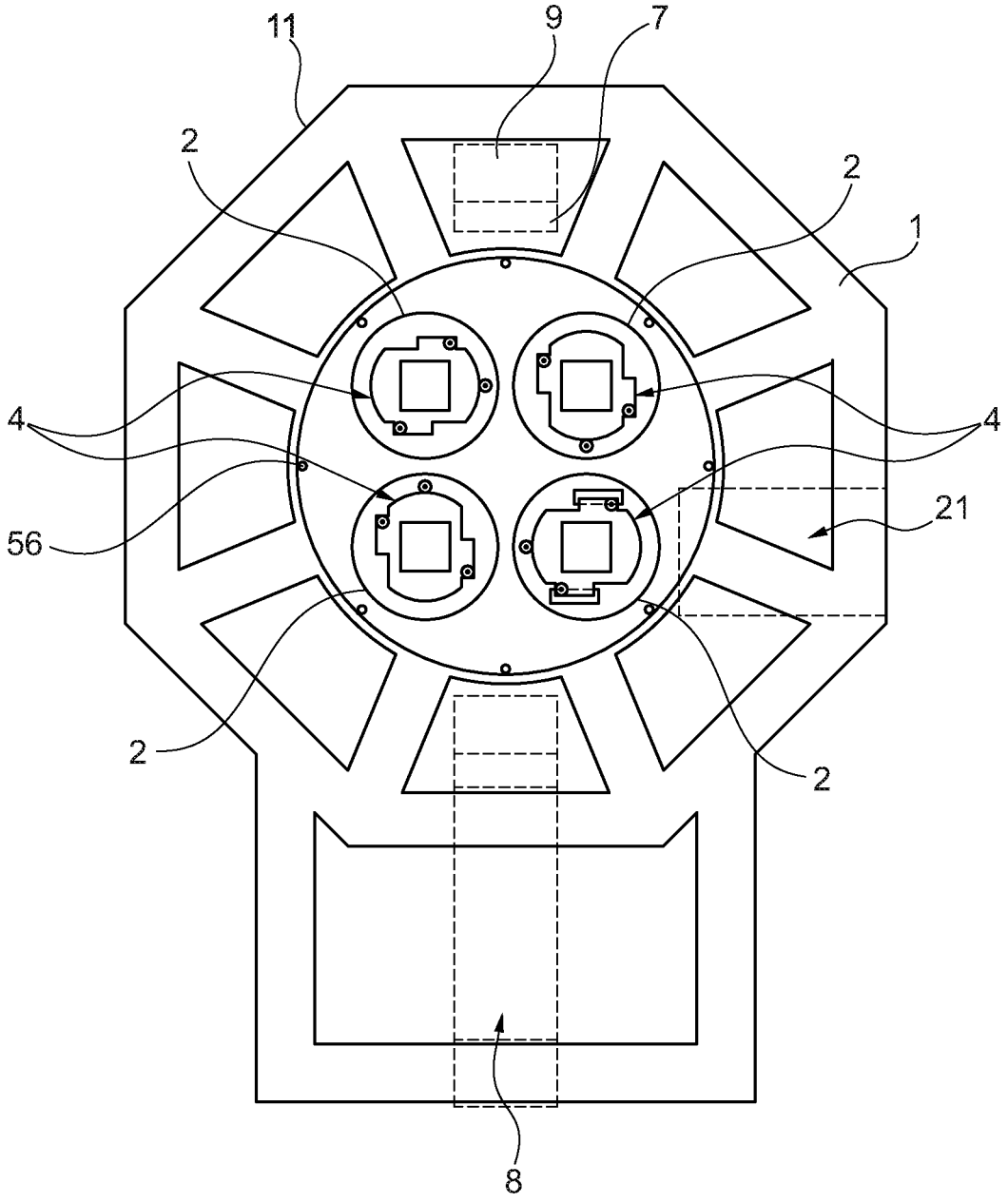
FIG. 18: a front view of a light according to the invention as a multiple light (without reflectors).

FIG. 18 shows a second embodiment of a light according to the invention. This differs from the light according to FIGS. 1 and 2 substantially only in its design as a multi, and specifically a quadruple light. It therefore comprises 4 LED chips 4, which are each fitted to a tube 3. Not only the power lines for supplying the LED chips 4 with electric energy run through the tubes 3, as they also each serve as a main cooling component for the LED chips 4. A plate on which a chip holder 5 with a current transmitter 6 according to FIGS. 4 to 7 is found is fitted to each tube 3.

As LED chips 4 can have a radiation angle of up to 120° due to their construction these can be fitted at an angle to the light level in order to be able to influence this physically predetermined radiation angle.

Each individual tube 3 is mounted in a first pivot bearing element 2, for example a ball bearing, so that one can rotate the tubes 3, and thus the LED chips 4, by up to 360°. Depending on the construction type the four LED chips 4 are positioned at angles from 0 to 90°. This means that the radiation angle can be enlarged many times.

The tubes 3 can further be influenced in such a way that the focus can be changed. For this the tubes 3 can be moved back and forth individually as well as together to adjust the depth up to the light level in order to obtain a common focus or a soft light.

This overall arrangement is now in turn mounted in a second pivot bearing element 56, in particular a ball bearing, to be able to fulfil a higher demand for light individuality with the possibility of individual rotations and by means of integrated reflectors.

The second pivot bearing element 56 also serves to guarantee a simple replacement of individual LED chips 4 via a single replacement shaft 21 in the multiple light. For this the corresponding one of the four tubes 4, on which the LED chip 4 to be replaced is arranged, is brought into a replacement position neighbouring the replacement shaft 21. The second pivot bearing element 56 has four arresting points for this, i.e. a matching replacement position for each LED chip 4, to guarantee a simple replacement. Replacing the LED chips 4 is realised via the replacement shaft 21 integrated (for example milled) into the housing 1. This replacement shaft 21 is arranged at the same angle at which the LED chips 4 are also aligned. Once the LED chips 4 have been replaced one by one as desired, the position of the LED chips 4 can be moved out of the (last) replacement position once more and normal use of the light can continue.

The overall construction is held by the housing 1, in particular in one design of an aluminium housing. The housing 1 is not completely filled, but adequate rigidity is achieved by means of targeted struts. At the same time the housing 1 allows sufficient space in the interior for enabling air circulation.

This air circulation serves for cooling the LED chips 4, which is realised in a targeted way by taking in external air through an air supply shaft 8. This air supply shaft runs through the housing in a front area before the LED chips 4, so that the air stream can be guided across the LED chips 4. The air stream is taken in by a fan 7 located next to the LED chips 4 and vented via an exhaust air shaft 9. A further fan (not illustrated) is arranged at the end of each tube 3 and vents heat generated by the LED chips 4 together with exhaust air collected in the front area in a lower area of the housing 1.

| List of reference numbers: | |
|---|---|
| 1 | Housing |
| 2 | (first) pivot bearing element |
| 3 | Tube |
| 4 | LED chip |
| 5 | Chip holder |
| 6 | Current transmitter |
| 7 | Fan |
| 8 | Air supply shaft |
| 9 | Exhaust air shaft |
| 10 | Illuminated surface |
| 11 | Base plate |
| 12 | Connection opening |
| 13 | Light key |
| 14 | Glide surface element |
| 15 | Holding element |
| 16 | Base body of current transmitter |
| 17 | Receiving slot of current transmitter |
| 18 | Metal current transmitter sheet |
| 19 | Compression spring of current transmitter |
| 20 | Current collector of LED chip |
| 21 | Replacement shaft |
| 22 | Shaft flap of replacement shaft |
| 23 | Threaded bolts of replacement shaft |
| 24 | Micro switch |
| 25 | Light key housing |
| 26 | Central part of light key housing |
| 27 | First end part of light key housing |
| 28 | Second end part of light key housing |
| 29 | Light key compression spring |
| 30 | Guide strut |
| 31 | Light key closure cap |
| 32 | Light key securing hook |
| 33 | Light key switch |
| 34 | Light key guide projection |
| 35 | Replacement shaft guide groove |
| 36 | Stopper in replacement shaft |
| 37 | Light key cartridge |
| 38 | Light key scraper |
| 39 | Replacement shaft receiving point |
| 40 | Plug-in transformer |
| 41 | Supply shaft |
| 42 | Supply shaft connections |
| 43 | Plug-in connector connections |
| 44 | Handle recess |
| 45 | Plug-in transformer guide groove |
| 46 | Supply shaft guide projection |
| 47 | Shaft flap |
| 48 | Shaft flap bolting |
| 49 | Supply shaft sealing element |

-continued

| List of reference numbers: | |
|---|---|
| 50 | Supply shaft inlet opening |
| 51 | Supply shaft outlet opening |
| 52 | Supply shaft through opening |
| 53 | Supply shaft facing wall |
| 54 | Supply shaft bulkhead |
| 55 | Supply shaft cable gland |
| 56 | Second pivot bearing element |

The invention claimed is:

1. A luminaire comprising:

a housing (1) having a cylindrical internal section, at least one pivot bearing element (2) located inside the cylindrical internal section, at least one tube (3) pivotably mounted inside the pivot bearing element (2), and a replacement shaft (21);

at least one LED chip (4) as a light source, the LED chip (4) being affixed to a facing side of the tube (3) and having a base plate (11), an illumination area (10) located on the base plate (11), and current collectors (20) initially extending from two opposing sides of the base plate (11) in a sideways direction and then angled downwards, the base plate (11) having two connection openings (12) for installing the LED chip (4) in the luminaire or for removing the LED chip (4) from the luminaire by using a light key (13); and a chip holder (5) having:

a glide surface element (14) forming a glide surface on which the base plate (11) of the LED chip (4) can glide, holding elements (15) connected with the glide surface element (14) at two opposing edges of the glide surface and each forming a guide slot with the glide surface, in which an edge section of the base plate (11) can be guided, and two current transmitters (6) extending along sides of the glide surface element (14) along which the holding elements (15) are fitted, each of the current transmitters (6) comprising an elongated base body (16) forming a receiving slot (17), which extends starting from one facing side of the base body (16) with decreasing width up to the vicinity of a second facing side of the base body (16) and which is designed open on a freely exposed top face of the respective current transmitter (6), which lies at approximately the same height as that of the glide surface, each current collector (20) being inserted into the receiving slot (17) of the respective associated current transmitter (6), the receiving slots (17) can be arranged parallel to the replacement shaft (21);

wherein the replacement shaft (21), with respect to a longitudinal axis of the tube (3), is arranged at the height of the LED chip (4).

2. The luminaire according to claim 1, further comprising a replaceable power supply.

3. The luminaire according to claim 1, further comprising a shaft flap (22) for closing the replacement shaft (21) on the outside.

4. The luminaire according to claim 1, wherein stoppers (36) are provided within the replacement shaft (21).

5. Light key (13) for transporting and replacing an LED chip (4) of a luminaire according to claim 1, comprising:

a housing (25) with a central part (26), a first end part (27) and a second end part (28), which can each be lowered into the central part (26), wherein the end parts (27, 28) are each driven into an extended position by means of compression springs (29), the LED chip (4) is located within a volume delimited by the first end part (27) in the extended position, and a free facing side of the end part (27) forms a through opening, which can be closed by means of a closure cap (31);

a guide strut (30), at the end of which the LED chip (4) can be held, extending from an internal bottom surface of the second end part (28); and two securing hooks (32), which engage the connection openings (12) of the base plate (11) of the LED chip (4) and serve for the disconnectable fitting of the LED chip (4) on the guide strut (30), the securing hooks (32) being mounted in a seesaw fashion and can be pushed into a closed position, in which the securing hooks (32) engage the connection openings (12), or an open position, in which the securing hooks (32) do not engage the connection openings (12), by means of a mechanical switch (33) integrated into the second end part (28).

6. Light key (13) according to claim 5, further comprising guide projections (34) for engaging corresponding guide grooves (35) of the replacement shaft (21) of the luminaire.

7. Light key (13) according to claim 5, further comprising a cartridge (37) located inside the first end part (27), in which a heat conductive paste is located, and a scraper (38) for coating the base plate (11) of the LED chip (4) with an even layer of the heat conductive paste.

8. Light key (13) according to claim 5, wherein the LED chip (4) is held hidden in the housing (25) in a transport position of the light key (13).

9. Light key (13) according to claim 5, wherein the LED chip (4) is held openly in the housing (25) in an opened position of the light key (13).

* * * * *